US005933172A

United States Patent [19]

Park et al.

[11] Patent Number: 5,933,172

[45] Date of Patent: Aug. 3, 1999

[54] INK SUPPLY DEVICE AND METHOD FOR REFILLING INK IN A HEAD OF AN INK-JET PRINTER

[75] Inventors: Jin-Ho Park, Sujung-gu; Sang-Won Cheong, Seoul, both of Rep. of Korea

[73] Assignee: SamSung Electronics Co., Ltd., Suwon, Rep. of Korea

[21] Appl. No.: 08/814,021

[22] Filed: Mar. 10, 1997

[30] Foreign Application Priority Data

Mar. 8, 1996 [KR] Rep. of Korea ..... 96-6142

[51] Int. Cl.[6] ..... B41J 2/175

[52] U.S. Cl. ..... 347/85

[58] Field of Search ..... 347/7, 85, 86, 347/87; 141/286

[56] References Cited

U.S. PATENT DOCUMENTS

| | | | |
|---|---|---|---|
| 3,882,909 | 5/1975 | Ogle | 141/286 |
| 4,739,347 | 4/1988 | Ishikawa et al. | 347/85 |
| 4,882,597 | 11/1989 | Sugiyama | 347/85 |
| 5,136,305 | 8/1992 | Ims | 347/7 |
| 5,469,201 | 11/1995 | Erickson et al. | 347/85 |
| 5,596,358 | 1/1997 | Hunt et al. | 347/85 |
| 5,598,198 | 1/1997 | Taylor et al. | 347/85 |

FOREIGN PATENT DOCUMENTS

| | | | |
|---|---|---|---|
| 0536980A2 | 4/1993 | France | B41J 2/175 |

*Primary Examiner*—N. Le
*Assistant Examiner*—Anh T. N. Vo
*Attorney, Agent, or Firm*—Robert E. Bushnell, Esq.

[57] ABSTRACT

An ink supply device for an ink-jet printer is disclosed, including a carriage held on a main frame and movable to right and left by a timing belt under the guidance of a carriage shaft; a head installed on the carriage and having a nozzle for spraying ink particles; a home position area where the carriage is moved periodically for cleaning or closing the head in response to a cleaning signal during printing; an ink storage tank installed on one side of the main frame to hold ink; and an ink refill unit rotatable in a counterclockwise direction for opening the ink storage tank to supply ink to the head, and rotatable in a clockwise direction to close the ink storage tank. The ink refill unit includes an ink supply pipe integrally formed under the ink storage tank, the ink supply pipe having an ink supply hole on one side and a closed tip; an elevating lever rotatably attached by a hinge pin to the main frame; an ink refill nozzle attached to the elevating lever, the ink refill nozzle moving downward along the ink supply pipe for opening the ink supply hole when the elevating lever rotates in the counterclockwise direction; a biasing device disposed between the elevating lever and the main frame for biasing the elevating lever in the clockwise direction when the carriage is moved from the home position area for moving the ink refill nozzle upward along the ink supply pipe for closing the ink supply hole.

19 Claims, 2 Drawing Sheets

INK SUPPLY DEVICE AND METHOD FOR REFILLING INK IN A HEAD OF AN INK-JET PRINTER

This application makes reference to, incorporates the same herein, and claims all benefits accruing under 35 U.S.C §119 from an application entitled *Ink Supply Device For Ink-Jet Printer* earlier filed in the Korean Industrial Property Office on 8 March 1996, and there duly assigned Ser. No. 96-6142 by that Office.

BACKGROUND OF THE INVENTION

1. Field of the Invention

The present invention relates to a device for refilling a head with ink in an ink-jet printer. More particularly, it relates to an ink supply device for an ink-jet printer which is designed to be small and light which will continuously furnish a minimum amount of ink to an ink-jet printer's recording head, and is of improved construction, thus assuring high speed performance.

2. Discussion of Related Art

Generally, an ink-jet printer uses electrostatic acceleration and deflection of ink particles discharged from nozzles to form characters on plain paper in a dot-matrix format. Such a printer includes a carriage that is held on a main frame and slides to right and left by a timing belt under the guidance of a carriage shaft, a head installed on the carriage and having a nozzle for spraying ink particles with the head's moving along with the carriage, and a home position area periodically cleaning or closing the head in response to a cleaning signal during printing. According to the ink-jet printer, as the carriage on the main frame moves to right and left, the head slides to right and left so that ink particles are jetted out from the nozzle of the head in a predetermined form to form characters on paper. One such ink-jet printer is discussed in U.S. Pat. No. 5,469,201 to Paul R. Erickson entitled *Ink Supply Line Support For Continuous Ink Refill System For Disposable Ink Jet Cartridges.*

U.S. Pat. No. 5,598,198 to Thomas N. Taylor, et al. entitled *Printer Ink Regulation System* describes a similar ink refilling system with ink is supplied to a print head through a tube, or conduit. This system utilizes a sensor to determine the level of ink in the head and controls a valve to open in order to supply ink from an ink supply tank which holds a large amount of ink

SUMMARY OF THE INVENTION

Accordingly, the present invention is directed to an ink supply device for an ink-jet printer which substantially obviates one or more of the problems due to limitations and disadvantages of the related art.

It is an object to provide an ink supply device for an ink-jet printer which is designed to be small and light to continuously furnish a minimum amount of ink to the printer's head, and is of improved construction, thereby assuring high speed performance.

It is yet another object to provide a method for refilling a head with ink in printer by continuously furnish a minimum amount of ink to the printer's head thereby reducing operation and maintenance costs.

To achieve these and other advantages and in accordance with the purpose of the present invention, as embodied and broadly described, the present invention relates to an ink supply device for an ink-jet printer including a carriage held on a main frame and moving right and left by a timing belt under the guidance of a carriage shaft; a head installed on the carriage and having a nozzle for spraying ink particles with the head's moving along with the carriage; a home position area for periodically cleaning or closing the head in response to a cleaning signal during printing; an ink storage tank installed on one side of the main frame to hold ink; and an ink refill unit for opening a pipe line of the ink storage tank to refill ink in the head when the carriage is moved to the home position area.

The ink refill unit may be constructed with a supply pipe, integrally formed under the ink storage tank, having an ink supply hole on one side and a closed tip; an elevating lever axially formed on the main frame to move in seesaw fashion about a hinge pin when the carriage is moved to home position area; an ink refill nozzle integrally formed on one end of the elevating lever moving upward and downward under the guidance of the ink supply pipe when the elevating lever moves in seesaw fashion in order to open or close the ink supply hole so as to supply the head with ink from the storage tank or cut off the ink supply; and an elastic member providing a biasing force against the elevating lever when the carriage is moved to a ready-to-print position so that the ink refill nozzle shuts the ink supply hole of the ink supply pipe. An air tube is formed to have one end connected to the ink storage tank's upper portion and the other end formed on the ink refill nozzle's end so as to allow atmospheric pressure to work when refilling ink in the head, cutting off the action of the atmospheric pressure by the ink in the head for the purpose of stopping the ink supply when the ink reaches a predetermined level. The ink refill nozzle includes an opening formed to move upward and downward under the guidance of the ink supply pipe; a nipple communicating with the opening and having a conic shape to refill ink in the head; and an ink passage having an ink inlet and an ink outlet each formed on its upper and lower portions so that they communicate with each other, and allows the ink supply hole of the ink supply pipe to communicate with the ink inlet or blocks a path between the ink supply hole and the ink inlet; a packing inserted within an entrance to the opening to provide a liquid-proof seal to the ink supply pipe; and a guide hole of rectangular shape, connected with one end of elevating lever by a guide pin at one side, and elevating in a vertical direction according to the elevating lever's rotational angle.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 1 schematically depicts a conventional ink-jet printer head holding ink;

FIG. 2 depicts an ink supply mechanism for an ink-jet printer which furnishes ink to a head from a conventional ink tank;

FIG. 3 schematically depicts an ink supply device for an ink-jet printer in accordance with the principles of the present invention;

FIG. 4A illustrates the inventive ink supply mechanism prior to refilling a tank of a print head in accordance with the principles of the present invention; and FIG. 4B illustrates the inventive ink supply mechanism during refill of the ink tank of the print head in accordance with the principles of the present invention.

DETAILED DESCRIPTION OF PREFERRED EMBODIMENT

Figure 1:
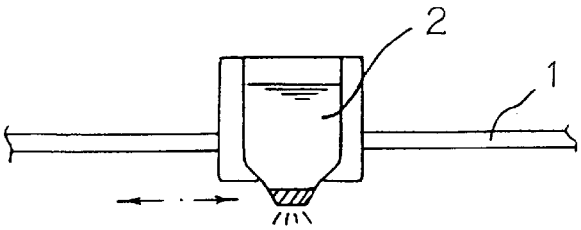
Fig. 1 (Prior Art)
Figure 2:
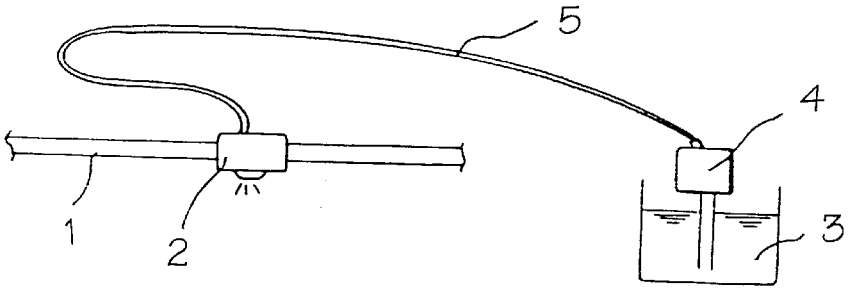
Fig. 2 (Prior Art)

FIGS. 1 and 2 are provide an exemplary illustration of an ink-jet printer similar to that in the 5,469,201 patent. Referring to FIG. 1, generally an ink cartridge and head unit, i.e., head 2, which slides to right and left under the guidance of carriage shaft 1 contains a predetermined amount of ink, and the printing operation is carried out until all the ink is used up. Once all the ink is used up then the ink cartridge incorporating head 2 has to be replaced, thus adding to the operating costs of the printer. Additionally, the head necessarily contains ink enough to print about 500 to 1000 sheets of paper, and the driving force for driving the head and the size of the printer depends on the head's size and weight. Since the ink cartridge and head needs to be large so that the ink cartridge and head unit need not be frequently replaced or the ink tank thereof frequently refilled, the power is to be relatively large to drive a large ink cartridge and head unit holding a maximum amount of ink. Because of the volume of ink that is in ready-to-use state, the ink cartridge and head unit takes up some space corresponding to the carriage's reciprocating distance so the printer is to be of large size.

In order to save the trouble of replacing the used ink cartridge and head unit with new one, an ink tank 3 is additionally installed on the printer, and a pump 4 forces ink to be continuously furnished to head 2 through a tube 5. This requires pump 4 to supply ink under a predetermined pressure, and tube 5 is formed of a flexible material in order to avoid hindering the movement of head 2. In addition, tube 5 has a dual pathway to collect surplus ink in order to prevent the ink supply pressure from influencing the nozzle.

Reference will now be made in detail to the preferred embodiments of the present invention, examples of which are illustrated in the accompanying drawings.

A printer includes a carriage 30 that is held on a main frame 10 and slides right and left by a timing belt under the guidance of a carriage shaft 20, a head 40 installed on carriage 30 and having a nozzle 41 for spraying, or discharging, ink particles as head 40 moves along carriage 30 during a print operation. Carriage 30 is periodically returned to a home position area 50 for cleaning or closing head 40 in response to a cleaning signal.

The printer also includes an ink storage tank 60 installed on one side of main frame 10 to hold ink, and an ink refill unit 70 for controlling the supply of ink to refill head 40 when carriage 30 is moved to home position area 50. Ink refill unit will be further described with respect to FIGS. 4A and 4B, below.

Ink refill unit 70 includes an ink supply pipe (or valve) 61 integrally formed under ink storage tank 60 and having an ink supply hole 62 on one side and a closed tip. An elevating lever 71 that is axially formed on main frame 10 to move in seesaw fashion about a hinge pin 72 when carriage 30 is moved to and from home position area 50. An ink refill nozzle 73, integrally attached on one end of elevating lever 71, opens or closes ink supply hole 62 when moved downward or upward, respectively, along ink supply pipe 61, to supply head 40 with ink or cut off the supply of ink to head 40. An elastic member 74, such as a compression spring, biases elevating lever 71 to rotate a clockwise direction when carriage 30 is moved to a ready-to-print position after head 40 has been refilled so that ink refill nozzle 73 moves upward to shut ink supply hole 62 of ink supply pipe 61. An air tube 75 is formed to have one end connected above the ink level in the upper portion of ink storage tank 60 and a distal end formed on the tip of ink refill nozzle 73 so as to allow atmospheric pressure to work when refilling ink in head 40, cutting off the action of the atmospheric pressure by the ink in head 40 for the purpose of stopping the ink supply.

Figure 4A:
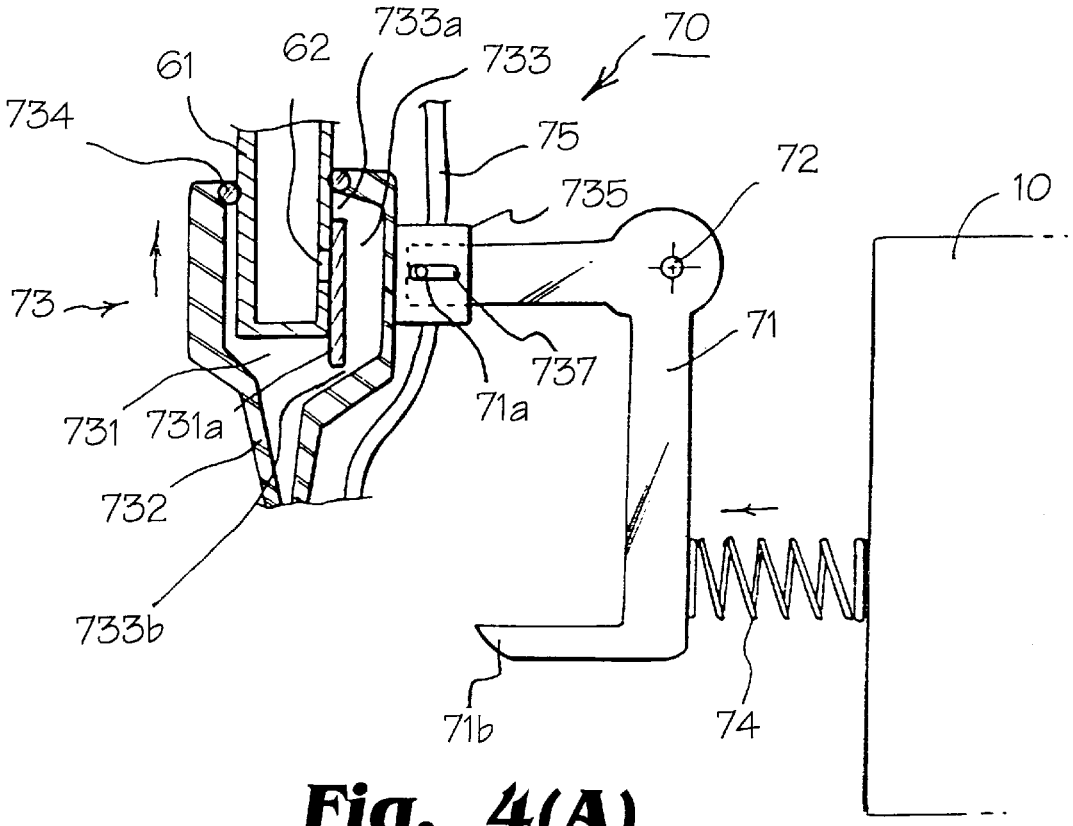

Referring further to FIG. 4A which shows ink refill unit in a closed position, ink refill nozzle 73 includes an opening 731 formed to accept ink supply pipe 61, which may be rectangular or round. A nipple 732, which communicates with opening 731, has a conic shape to fill ink in head 40. An ink passage 733 that has an ink inlet 733*a* and an ink outlet 733*b* leading to the opening in lead pipe 732. Ink supply hole 62 of ink supply pipe 61 is sealed by a side wall 731*a* of opening 731 to prevent ink from entering nozzle 73.

Ink refill nozzle 73 also includes a packing 734 inserted within an entrance to opening 731 to provide a liquid-proof seal to ink supply pipe 61, and a bracket, or tab, 735 having an elongated guide hole 737 that is connected with one end of elevating lever 71 by a guide pin 71*a* at one side thereof. In this preferred embodiment of the present invention, a coil spring, or compression spring, serves as elastic member 74, however, a torsion spring located at an alternative position on the main frame may be used.

Figure 3:
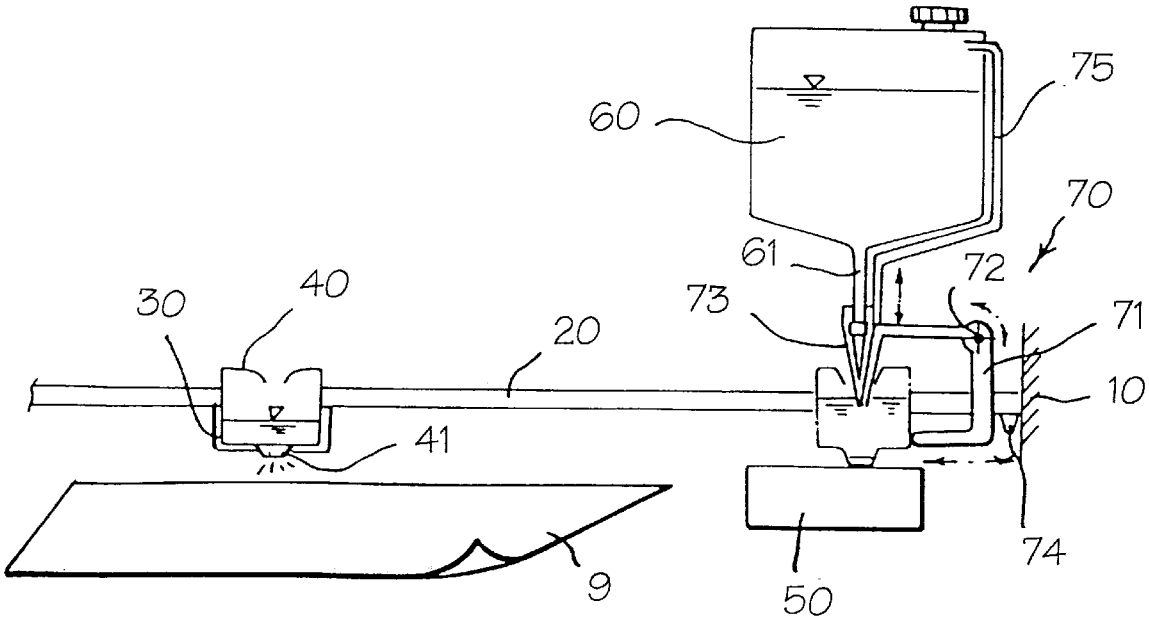
Figure 4B:
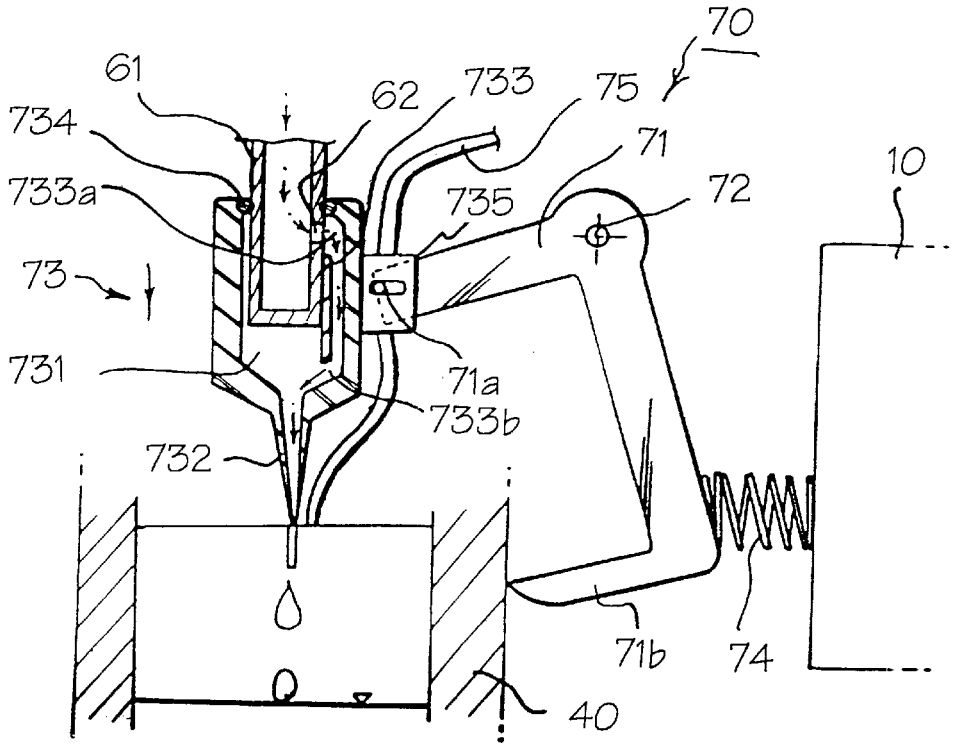

Referring now to FIG. 4B, when carriage 30 is moved to home position area 50, as shown in FIG. 3, print head 40 engages toe end 71*b* of elevating lever 71 causing elevating lever to rotate counterclockwise around hinge pin 72 while simultaneously compressing elastic member 74. Ink refill nozzle 73 connected to guide pin 71*a* is lowered vertically by elevating lever 71 being rotated in the counterclockwise direction. Accordingly, ink inlet 733*a* of refill nozzle 73 aligns with ink supply hole 62 of ink supply pipe 61 and ink held in ink storage tank 60 is provided to head 40 through the path formed by ink supply pipe 61, ink supply hole 62, ink inlet 733*a*, ink passage 733, ink outlet 733*b* and nipple 732.

When the ink in head 40 ink is reduced by use to a predetermined level, the end of air tube 75 formed with the tip of nozzle 73 is exposed to the atmosphere, and the atmospheric pressure acts on the interior of ink storage tank 60. Accordingly, the communication between ink inlet 733*a* of ink refill nozzle 73 and ink supply hole 62 of ink supply pipe 61 and the action of the atmospheric pressure within ink storage tank 60 by air tube 75 allows ink to refill head 40 through ink supply pipe 61 and ink refill nozzle 73. When ink refills head 40 above the predetermined level, i.e. when ink fills head 40 up to the end of air tube 75 formed with the tip of nozzle 73, the atmospheric pressure is not introduced into air tube 75 so the atmospheric pressure cannot work within ink storage tank 60, and a vacuum pressure is formed within the interior of ink storage tank 60 by the exclusion of the atmospheric pressure, thus preventing ink from exiting ink supply hole 62 thus preventing overflow and loss of ink, and avoids staining a users' fingers or clothes with ink.

When head 40 slides to a printing area for printing in response to a print control signal and after the ink has filled up head 40 the end of air tube 75 formed with the tip of nozzle 73 is again exposed to the atmosphere. However, the moment head 40 is separated from elevating lever 71, the biasing force of compressed elastic member 74 rotates elevating lever 71 clockwise to return it to its original state. Accordingly, ink refill nozzle 73 connected with guide pin 71 moves directly upward along pipe 61 thus blocking a path between ink supply hole 62 and ink inlet 733*a*. Accordingly, ink supply hole 62 will be positioned behind side wall 731*a* between ink inlet 733*a* and ink outlet 733*b* and the in ink storage tank 60 is prevented from existing ink supply hole 62. Additionally, ink inlet 733*a* will be blocked by pipe 61 and a vacuum is formed in nozzle 73 to prevent ink from exiting nozzle 73.

Accordingly, head 40 is to be filled with a predetermined amount of ink, and when ink usage is irregular on every sheet of print media or during graphic printing, the ink in ink storage tank 60 available to refill head 40. Accordingly, head 40 can of a reduced size making it light in order to reduce the consumption of power necessary for driving head 40, thereby obtaining advantages of the simplification of structure and decrease in the production costs. Also, head 40 can be driven at higher speeds, enhancing the printer performance. Subsequently, the smaller size of head 40 will reduce the space necessary for head 40, and the printer size can be small, and an ink cartridge for ink supply is not required, thereby ensuring a reduction in printing costs. Further, an ink level indicator may be provided to the ink storage tank to inform a user when it is time to refill ink storage tank 60.

It will be apparent to those skilled in the art that various modifications and variations can be made in the ink supply device of the present invention without departing from the spirit or scope of the invention. For example, a sensor could be provided to determine when the ink in head 40 needs to be refilled thus controlling carriage 30 to return to the come position. Thus, it is intended that the present invention cover the modifications and variations of this invention provided they come within the scope of the appended claims and their equivalents.

What is claimed is:

1. An ink supply device for refilling ink in a head of an ink-jet printer having a carriage shaft mounted to a main frame of the printer, a carriage which moves along said carriage shaft in response to a timing belt and said head being mounted on the carriage, said head having a nozzle for discharging ink particles as the head moves along with the carriage during a print operation and a home position area to where said carriage is moved periodically for cleaning the head in response to a cleaning signal, said ink supply device comprising:

an ink storage tank installed on one side of said main frame to hold ink; and refill means comprising an elevating lever, said elevating lever rotating, when said carriage is moved to said home position area, in a first direction for opening said ink storage tank to supply ink to said head when ink in said head is below a predetermined level, and rotating in a second direction to close said ink storage tank when said carriage is moved away from said home position area.

2. The ink supply device as set forth in claim 1, wherein said refill means comprises:

an ink supply pipe integrally formed under said ink storage tank for receiving ink from said ink storage stank, said ink supply pipe having an ink supply hole on one side and a closed tip;

said elevating lever rotatably attached by a hinge pin to said main frame, said elevating lever having a pin formed on one end thereof and a toe formed on an opposite end, said elevating lever rotating in said first direction in response to a drive force caused by said carriage contacting said toe when said carriage is moved to said home position area;

an ink refill nozzle integrally attached to said pin formed on said one end of said elevating lever, said ink refill nozzle moving downward along said ink supply pipe for opening said ink supply hole when said elevating lever rotates in said first direction;

biasing means disposed between said opposite end of said elevating lever and said main frame for biasing said elevating lever in said second direction when said carriage is moved from said home position area; and said ink refill nozzle moving upward along said ink supply pipe for closing said ink supply hole when said elevating lever rotates in said second direction.

3. Then ink supply device as set forth in claim 2, further comprising:

an air tube having one end connected to an upper portion of said ink storage tank and an opposite end attached to said ink refill nozzle, said opposite end of said air tube being positioned at said predetermined level for permitting air to traverse through said air tube to said upper portion of said ink storage tank when said ink is below said predetermined level to enable ink to exit through said ink supply hole when said ink supply hole is open, said air tube being closed off for creating a vacuum in said air tank to prevent ink from exiting said ink supply hole when said ink is above said predetermined level.

4. The ink supply device as set forth in claim 2, wherein said ink refill nozzle comprises:

a first cavity formed to slidably engage said ink supply pipe for enabling said ink refill nozzle to be moved along said ink supply pipe, said cavity having a wall for sealing said ink supply hole when said elevating lever is rotated in said second direction;

a second cavity forming an ink passage having an ink inlet and an ink outlet, said ink inlet being aligned with said ink supply hole when said carriage is moved to said home position area for permitting said ink to flow from said ink supply hole through said ink passage; and a nipple for receiving said ink flowing through said passage via said ink outlet, and for supplying said ink to said head.

5. The ink supply device as set forth in claim 2, wherein said ink refill nozzle further comprises:

a packing inserted within an entrance to said first cavity to provide a liquid-proof seal between said ink refill nozzle and said ink supply pipe; and a bracket comprising an elongated guide hole for receiving said pin formed on said one end of said elevating lever.

6. An ink supply method for refilling ink in a head of an ink-jet printer having a carriage shaft mounted to a main frame of the printer, a carriage which moves along said carriage shaft in response to a timing belt and said head being mounted on the carriage, said head having a nozzle for discharging ink particles as the head moves along with the carriage during a print operation and a home position area to where said carriage is moved periodically for cleaning the head in response to a cleaning signal, said method comprising:

providing a driving force for moving said carriage to said home position in response to said cleaning signal;

rotating an elevating lever in a first direction in response to contact between said elevating lever and said head mounted to said carriage when said carriage moves into said home position area;

lowering a nozzle along an ink supply pipe extending from a bottom portion of an ink supply tank as said elevating lever rotates in said first direction for unsealing an ink supply hole in one side of said ink supply pipe; and supplying ink from said ink supply hole through an ink supply path in said nozzle to refill said head.

7. The method as set forth in claim 6, further comprising the steps of:

supplying air through an air supply tube into a top portion of said ink supply tank for enabling said ink to exit said ink supply hole; and shutting off said air supplied through said air supply tube when ink in said head is refilled to a predetermined level to prevent said ink from exiting said ink supply hole by establishing a vacuum in said ink supply tank.

8. The method as set forth in claim 6, further comprising the steps of:

providing a second driving force for moving said carriage away from said home position in response to a print control signal;

rotating said elevating lever in a second direction in response to a biasing force exerted by a compression spring when said carriage is moved away from said home position; and raising said nozzle along said ink supply pipe as said elevating lever rotates in said second direction for sealing said ink supply hole in said one side of said ink supply pipe.

9. An ink supply device for refilling ink in a head of an ink-jet printer, said ink supply device comprising:

a carriage shaft mounted to a main frame of said printer;

a carriage which moves along said carriage shaft in response to a timing belt, said head being mounted on said carriage;

a home position area to where said carriage is moved periodically in response to a control signal for cleaning said head and for refilling ink in said head;

an ink storage tank for holding ink, said ink storage tank being installed above said home position area;

valve means extending below said ink storage tank for transferring ink from said ink storage tank to said head; and valve control means rotatable in a first direction for opening said valve means to supply ink to said head when ink in said head is below a predetermined level when said carriage is moved to said home position area, and rotatable in a second direction to close said valve means when said carriage is moved away from said home position area.

10. The ink supply device as set forth in claim 9, wherein said valve control means comprises:

an elevating lever rotatably attached by a hinge pin to said main frame, said elevating lever having a pin formed on one end thereof and a toe formed on an opposite end, said elevating lever being rotated in said first direction in response to a drive force caused by said carriage contacting said toe when said carriage is moved to said home position area;

biasing means disposed between said opposite end of said elevating lever and said main frame for biasing said elevating lever in said second direction when said carriage is moved away from said home position area.

11. The ink supply device as set forth in claim 10, wherein said valve means comprises:

an ink supply pipe integrally formed under said ink storage tank for receiving ink from said ink storage tank, said ink supply pipe having an ink supply hole on one side and a closed tip;

an ink refill nozzle attached to said pin formed on said one end of said elevating lever, said ink refill nozzle moving downward along said ink supply pipe for opening said ink supply hole when said elevating lever rotates in said first direction; and said ink refill nozzle moving upward along said ink supply pipe for closing said ink supply hole when said elevating lever rotates in said second direction.

12. Then ink supply device as set forth in claim 11, further comprising:

an air tube having one end connected to an upper portion of said ink storage tank and an opposite end attached to said ink refill nozzle, said opposite end of said air tube being positioned at said predetermined level for permitting air to traverse through said air tube to said upper portion of said ink storage tank when ink in said head is below said predetermined level to enable ink to exit through said ink supply hole when said ink supply hole is open, said air tube being closed off for creating a vacuum in said air tank to prevent ink from exiting said ink supply hole when said ink in said head is above said predetermined level.

13. The ink supply device as set forth in claim 11, wherein said ink refill nozzle comprises:

a first cavity formed to receive said ink supply pipe for enabling said ink refill nozzle to be moved along said ink supply pipe wherein a wall in said cavity seals said ink supply hole when said elevating lever is rotated in said second direction;

a second cavity forming an ink passage adjacent said first cavity, said ink passage having an ink inlet and an ink outlet, said ink inlet being aligned with said ink supply hole when said carriage is set in said home position area for permitting said ink to flow from said ink supply hole through said ink passage; and a nipple for receiving said ink flowing through said passage via said ink outlet and for supplying said ink to said head.

14. The ink supply device as set forth in claim 11, wherein said ink refill nozzle further comprises:

a packing inserted within an entrance to said cavity to provide a liquid-proof seal between said ink refill nozzle and said ink supply pipe; and a bracket comprising an elongated guide hole for receiving said pin formed on said one end of said elevating lever.

15. The ink supply device as set forth in claim 10, wherein said biasing means comprises a compression spring.

16. The ink supply device as set forth in claim 9, wherein said valve means comprises:

an ink supply pipe integrally formed under said ink storage tank for receiving ink from said ink storage tank, said ink supply pipe having an ink supply hole on one side and a closed tip;

an ink refill nozzle attached to said valve control means, said ink refill nozzle moving downward along said ink supply pipe for opening said ink supply hole when said valve control means rotates in said first direction; and said ink refill nozzle moving upward along said ink supply pipe for closing said ink supply hole when said valve control means rotates in said second direction.

17. The ink supply device as set forth in claim 16, wherein said ink refill nozzle comprises:

a cavity formed to receive said ink supply pipe for enabling said ink refill nozzle to slide along said ink supply pipe, said cavity having a wall for sealing said ink supply hole when said valve control means is rotated in said second direction;

an ink passage having an ink inlet and an ink outlet, said ink inlet being aligned with said ink supply hole when said valve control means is rotated in said first direction for permitting ink to flow from said ink supply hole through said ink passage; and a nipple for receiving ink flowing through said passage via said ink outlet and for supplying said ink to said head.

18. Then ink supply device as set forth in claim 9, further comprising:

an air tube having one end connected to an upper portion of said ink storage tank and an opposite end attached to said valve means, said opposite end of said air tube being positioned at said predetermined level for permitting air to traverse through said air tube to said upper portion of said ink storage tank when ink in said head is below said predetermined level to enable ink to flow from said ink storage tank, said air tube being closed off for creating a vacuum in said air tank to prevent ink from flowing from said ink storage tank when said ink in said head is above said predetermined level.

19. The ink supply device as set forth in claim 9, wherein said control signal comprises a head cleaning signal for controlling said timing belt to move said carriage to said home position area.

* * * * *